United States Patent [19]

Boswell

[11] Patent Number: 4,869,180

[45] Date of Patent: Sep. 26, 1989

[54] LEG STRUCTURE FOR SUPPORTING A TABLE LEAF FOR USE AS A SEPARATE TABLE

[76] Inventor: James W. Boswell, 1196 Carriage Way N., E. Lansing, Mich. 48823

[21] Appl. No.: 329,341

[22] Filed: Mar. 27, 1989

[51] Int. Cl.[4] ..... A47B 3/06

[52] U.S. Cl. ..... 108/157; 108/159

[58] Field of Search ..... 108/157, 159, 155, 156; 248/188

[56] References Cited

U.S. PATENT DOCUMENTS

| | | | |
|---|---|---|---|
| 1,851,131 | 3/1932 | Rowley | 108/157 X |
| 2,903,312 | 9/1959 | Lawless | 108/159 X |
| 3,537,408 | 11/1970 | Bartlett et al. | 108/156 |
| 3,696,763 | 10/1972 | Evans | 108/157 |
| 3,912,210 | 10/1975 | Bohr | 108/159 X |
| 4,341,164 | 7/1982 | Johnson | 108/157 X |
| 4,645,161 | 2/1987 | Collins | 248/188 X |

*Primary Examiner*—Peter A. Aschenbrenner
*Attorney, Agent, or Firm*—Harness, Dickey & Pierce

[57] ABSTRACT

A leg support structure is disclosed for use with a removable table leaf to enable the table leaf to be used as a separate stand alone table. The support structure includes a pair of side support members which support the table leaf along the longitudinal side edges thereof and includes vertical leg portions for supporting the structure on a floor. A pair of end support brackets are attached to corresponding legs from the two side support members to form a rectangular support structure for the table leaf. The side support members are constructed such that the length can be varied to accommodate table leaves of various lengths and the end support brackets are constructed so that the width of the leg support structure can also be varied to accommodate leaves of various widths.

8 Claims, 3 Drawing Sheets

LEG STRUCTURE FOR SUPPORTING A TABLE LEAF FOR USE AS A SEPARATE TABLE

BACKGROUND AND SUMMARY OF THE INVENTION

This invention relates to a leg support structure and in particular to a leg support structure to adapt a removable table leaf for use as a separate table.

It is not uncommon for dining room tables and kitchen dinette tables to be equipped with one or more table leaves which are used to expand the size of the table if necessary to accommodate a greater number of persons. When not in use, the table leaves often present difficulty in being properly stored. One common place for storing table leaves is under a bed; however, in such a location they are prone to collecting dust and must be periodically cleaned. While in storage, the table leaves serve no useful purpose.

Accordingly, it is an object of this invention to provide a support structure to enable a table leaf to be used as a separate, stand alone table while not being used as a leaf with its associated table.

It is an advantage of the present invention that the table, by being constructed of a table leaf, will match the table to which the leaf is associated.

It is a further advantage of this invention to provide a useful function for a table leaf when not being used as a table leaf.

The leg structure of this invention includes two side support members for supporting the table leaf along the longitudinal edges of the leaf. End support brackets are used to attach the two side support members in a spaced parallel relationship to each other such that the table leaf can be supported between the two side support members. The side support members and the end support brackets include inwardly directed flanges for use in supporting the leaf thereon.

The side support members each include a pair of legs having a vertical portion and a horizontal portion extending from the upper end of the vertical portion at a right angle thereto, and a middle support bracket which attaches the horizontal portions of the two legs together, thus forming the side support member. The attachment of the middle support bracket to the horizontal portions of the legs is through slotted connections to enable the length of the side support members to be varied to accommodate table leaves of various lengths. Likewise, the end support brackets are attached to the vertical portion of the legs through slotted connections to enable the width of the leg structure to be varied to accommodate table leaves of various widths.

Further objects, features and advantages of the invention will become apparent from a consideration of the following description and the append claims when taken in connection with the accompanying drawings.

DETAILED DESCRIPTION OF THE PREFERRED EMBODIMENT

Figure 1:
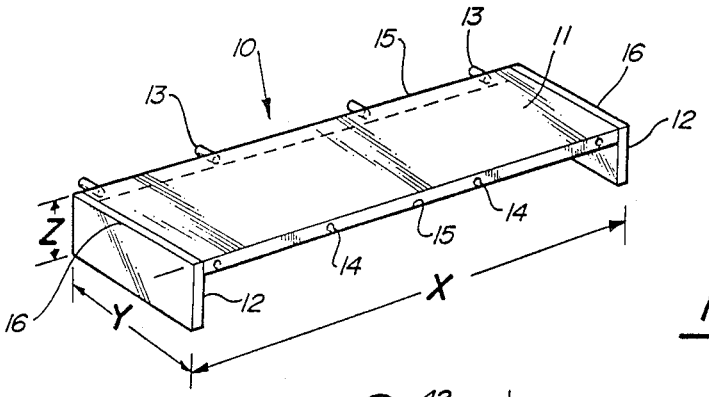
FIG. 1 is a perspective view of a typical table leaf.

A table leaf for use with the leg support structure of this invention is shown in FIG. 1 and designated generally at 10. The table leaf 10 comprises a top panel 11 having two end panels 12 attached at each end of the top panel 11. Dowels 13 extend laterally from one side of the top panel 11 which are engagable with apertures in a mating leaf or the table from which the leaf 10 has been removed. The opposite edge of the top panel 11 includes corresponding dowel apertures 14 for receiving dowels from an adjacent leaf or adjacent table top from the associated table. The table leaf 10 is shown having a longitudinal side edges 15 of length X, a width Y and a vertical height Z.

Figure 2:
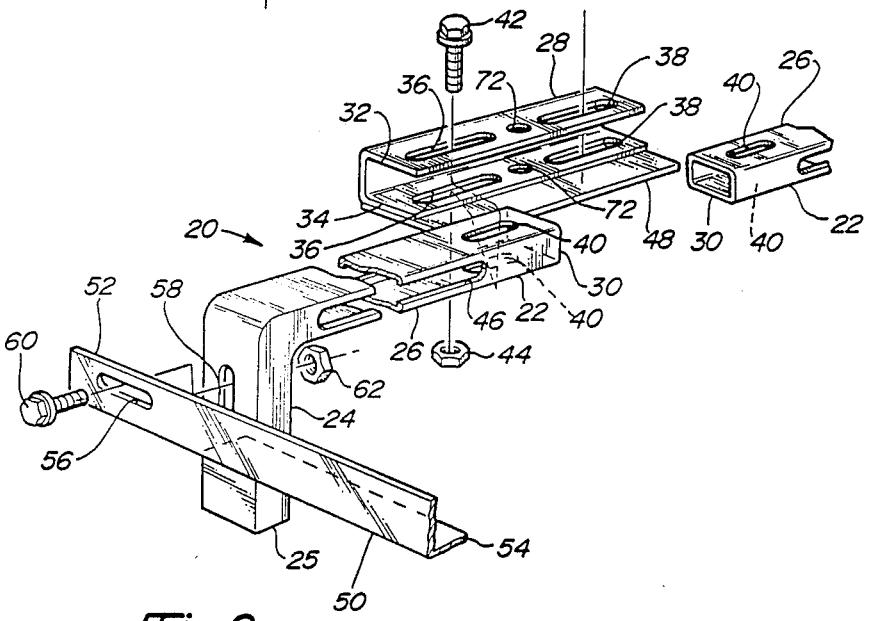
FIG. 2 is an exploded perspective view of a portion of the leg structure of this invention.

A portion of a side support member 20 is shown in an exploded perspective view in FIG. 2. The leg structure of this invention includes two identical side support members 20 which are used to support the table leaf 10 along the two longitudinal side edges 15. The side support member 20 includes two identical leg members 22. The leg members 22 include a vertical portion 24 and a horizontal portion 26 which extends at a right angle from the upper end of the vertical portion 24. The lower ends 25 of the legs 22 contact the floor upon which the leg support structure is placed. A middle support bracket 28 is used to attach the free extending ends 30 of two leg members 22 together to form a side support member 20. The assembled side support members form an inverted "U" with the legs of the "U" extending downward and resting upon the floor.

The leg members 22 are formed of a square or rectangular hollow tube and the middle support bracket 28 is constructed of a generally U-shaped bracket which is of a size and shape to fit around three sides of the leg member 22 hollow tube. The middle support bracket 28 has an upper flange 32 and a parallel lower flange 34. A pair of parallel slots 36 are provided in the upper and lower flanges 32 and 34 at one end of the bracket 28 and another pair of identical slots 38 are provided in the opposite end of the middle support bracket 28. The slots 36 and 38 in the middle support bracket are positioned over the slots 40 provided in the top and bottom surfaces of the leg members 22 adjacent to the ends 30. By overlapping a portion of the slots 36 and 38 with the slots 40, an attaching bolt 42 can be extended through the slots and secured by a nut 44 on the lower side of the bracket 28 to secure the middle support bracket 28 to a pair of leg members 22 to form a side support member 20.

The use of slots 36, 38, and 40 enables the length of the side support members to be varied to accommodate table leaves having various longitudinal dimensions X. A slot 46 is provided in the side of the horizontal portion of the leg member. The slot 46 is used to accommodate the dowels 13 projecting from the side of the table leaf 10 to enable the table leaf to be placed in the leg support structure with the side edge 15 in engagement with the side support members. A flange 48 extends horizintally from the lower edge of bracket 28 and projects inwardly toward the opposite side support member of the leg support structure for supporting the top panel 11 of the table leaf thereon.

Figure 3:
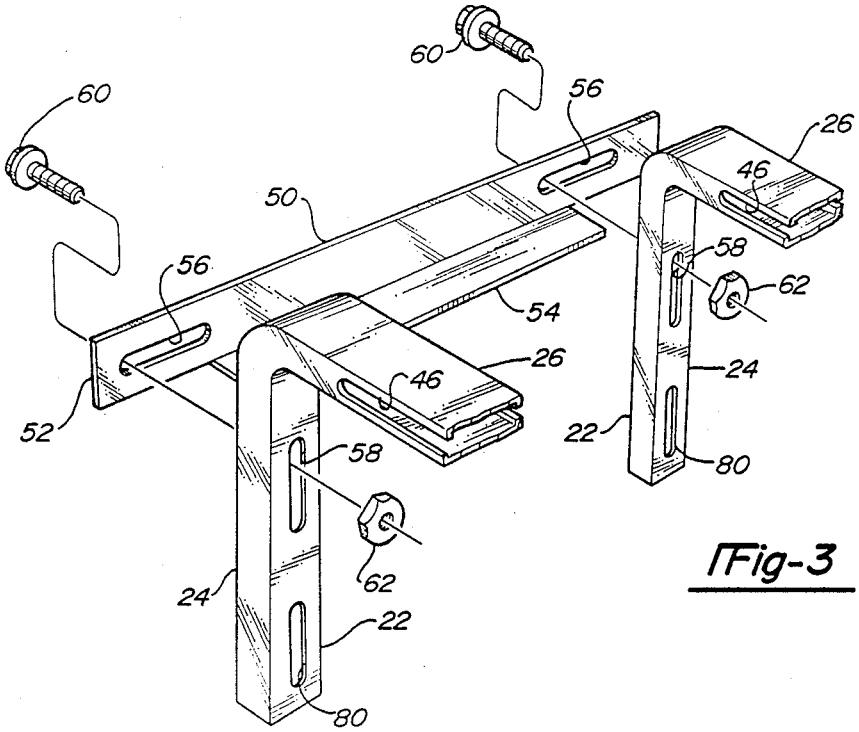
FIG. 3 is an exploded perspective view of an end bracket and a portion of the side support members.

An end support bracket 50 is attached to the upper end of the vertical portion 34 of the leg member 22. The end support bracket has a vertical plate portion 52 an a horizontal plate portion 54. The vertical plate portion 52 includes a horizontal slot 56 near each end which is aligned with a vertical slot 58 in the legs 22 adjacent the upper end of the vertical portion 24. A bolt 60 is extended through the slots 56 and 58 and secured by a nut 62 to attach the end support bracket 50 to the side support member 20. The other end of the end support bracket 50 is attached to the other side support member, as shown in FIG. 3, to attach the pair of side support members together in a parallel spaced relationship. The horizontal plate portion 54 extends inwardly relative of the leg structure toward an identical end support bracket 50 at the opposite end of the leg structure and is used to support the bottom of the end panel 12 of the leaf 10 thereon. The slot 58 is provided in the leg 22 to enable the position of the end support bracket 50 to be varied vertically such that the horizontal plate portion 54 will support the table leaf 10 with the upper surface of the top panel 11 flush with the top of the leg members 22. Slots 56 are provided in the end support brackets 50 so that the distance between the two side support members can be varied to accommodate table leaves having varying width dimensions Y.

Figure 4:
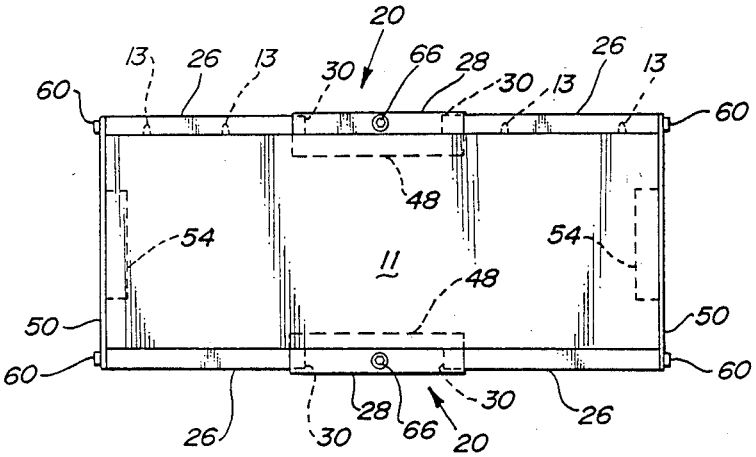
FIG. 4 is a top plan view of the assembled table according to this invention.

FIG. 3 shows a perspective view of the end support bracket 50 in an exploded relationship to two legs 22 at one end of the side support members. FIG. 4 is a top plan view of the assembled leg structure with the leaf in place with the longitudinal side edges 15 adjacent the two side support members 20. Two end support brackets 50 are shown attached to the ends of the side support members 20 by bolts 60. The flanges 48 and 54 of the middle support brackets 28 and end support brackets 50, respectively, are shown underlaying the table leaf 10 for supporting the leaf thereon.

Figure 5:
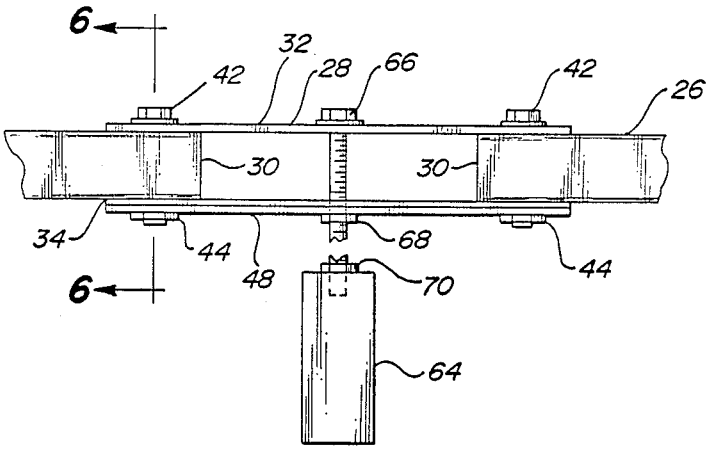
FIG. 5 is a side elevational view showing a modified form of the present invention having a middle support leg.

FIG. 5 illustrates an optional middle leg extending downwardly from the middle support bracket 28. The middle leg includes a lower support block 64 which rests upon the floor and a bolt 66 extending through the middle support bracket 28. A retaining nut 68 is used to retain the bolt 66 to the support bracket 28 and a second nut 70 is used to secure the block 64 to the end of bolt 66. The bolt 66 extends through a pair of apertures 72 in the middle support bracket 28.

Figure 6:
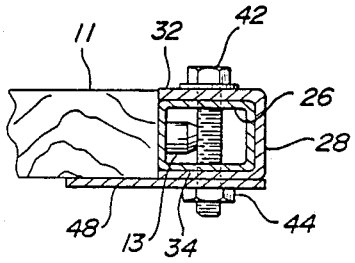
FIG. 6 is a sectional view of the middle support bracket of the side support member.

FIG. 6 is a cross section taken through line 6—6 of FIG. 5. FIG. 6 illustrates the middle support bracket 28 surrounding the leg member 22 and the dowel 13 extending into the leg member 22.

Figure 7:
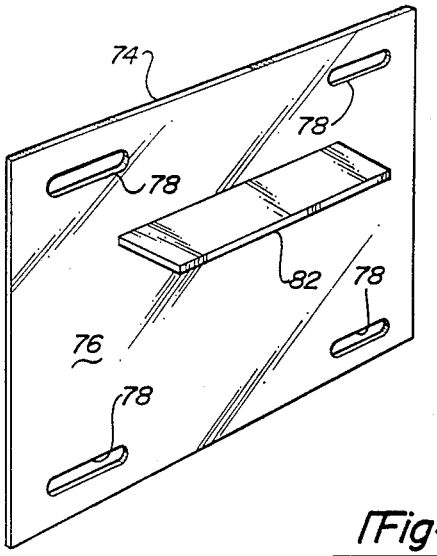
FIG. 7 is a perspective view of a modified form of the end support bracket.

An optional end support bracket structure 74 is shown in FIG. 7. The end support bracket 74 includes a larger vertical plate portion 76 in place of the vertical portion 52 of end support bracket 50. The vertical plate portion 76 has four slots 78 replacing the two slots 56 of bracket 50 for attaching the end support bracket to the legs 22. The pair of upper slots 78 are attached to the legs 22 through slots 58, shown in FIG. 3, while the lower pair of slots 78 are attached to the slots 80 in the leg members 22 shown in FIG. 3. The end support bracket 74 is used to provide additional rigidity to the leg support structure than is provided with end support bracket 50. Like end support bracket 50, the support bracket 74 includes a horizontal portion 82 upon which the bottom of the end panels 12 are supported.

It is seen from the above that the leg structure of this invention provides a useful support structure for a table leaf to enable the table leaf to be used as a separate stand alone table. The leg structure is provided with adjustable connections to enable the leg structure to support various sized table leaves. The leg support structure can be made with various decorative finishes to match the table leaf which it is used. The leg members 22 can be made with the vertical portions 24 of appropriate lengths such that the table can be used as a cocktail table, sofa table or serving table, etc.

It is to be understood that the invention is not limited to the exact construction illustrated and described above, but that various changes and modifications may be made without departing from the spirit and scope of the invention as defined in the following claims.

What is claimed is:

1. Leg structure for supporting a rectangular table leaf for use as a separate table comprising:

a pair of side support members for supporting said table leaf along lengthwise edges of the leaf with one side support member at each lengthwise edge of said leaf, said side support members each including a pair of leg members having a vertical portion with lower and upper ends and a horizontal portion extending from the upper end of said vertical portion in a generally horizontal direction, the horizontal portions of said pair of leg members attached to one another by a middle support bracket;

said pair of side support members attached to each other in spaced parallel relationship by a pair of end support brackets which extend in a direction perpendicularly to the lengthwise direction of said pair of side support members to form a rectangular frame having a size corresponding to the size of said table leaf, said end support brackets attached to the vertical portions of the corresponding leg members of each pair of side support members;

means for adjusting the horizontal length of said side support members and for adjusting the distance which said side support members are spaced from one another to enable use of the leg structure with table leaves having a variety of sizes; and means associated with said side support members and said end support brackets for engaging said table leaf to support said leaf.

2. The structure of claim 1 wherein said leg members are constructed of hollow tubing.

3. The structure of claim 2 wherein said middle support brackets include a "U" shape bracket of a size and shape to fit over the leg member tubing and having a horizontal flange extending in a direction toward the other of said pair of side support members for supporting said leaf thereupon.

4. The structure of claim 2 wherein said end support brackets include a horizontal flange extending in a direction toward the other end support bracket for supporting said leaf thereupon.

5. The structure of claim 1 wherein said adjusting means comprises slotted connections between the leg members and the middle support bracket and between the leg members and the end support brackets.

6. The structure of claim 1 further comprising a middle support leg extending downwardly from each middle support bracket to provide additional strength to said leg structure.

7. The structure of claim 1 wherein the end support bracket is attached to each leg member through one slotted connection.

8. The structure of claim 1 wherein the end support bracket is attached to each leg member through two slotted connections.

* * * * *